US006308352B1

(12) United States Patent
Cheng

(10) Patent No.: US 6,308,352 B1
(45) Date of Patent: Oct. 30, 2001

(54) FOLDABLE BASE FOR A PLAYPEN

(76) Inventor: Ching-Wen Cheng, 3rd Fl., No. 100, Wenlin N. Rd., Peitou Dist., Taipei (TW)

( * ) Notice: Subject to any disclaimer, the term of this patent is extended or adjusted under 35 U.S.C. 154(b) by 0 days.

(21) Appl. No.: 09/569,989

(22) Filed: May 11, 2000

(30) Foreign Application Priority Data

May 20, 1999 (TW) ..... 088208096

(51) Int. Cl.[7] ..... A47D 13/06
(52) U.S. Cl. ..... 5/99.1; 5/98.1
(58) Field of Search ..... 5/99.1, 98.1, 93.1, 5/98.3; 403/102, 117, 119

(56) References Cited

U.S. PATENT DOCUMENTS 5,394,574 * 3/1995 Chuang ..... 5/99.1
5,781,944 * 7/1998 Huang ..... 5/99.1
5,970,540 * 10/1999 Cheng ..... 5/99.1
6,065,163 * 5/2000 Hung ..... 5/99.1

* cited by examiner

*Primary Examiner*—Lynne H. Browne
*Assistant Examiner*—Frederick Conley
(74) *Attorney, Agent, or Firm*—Dellett and Walters

(57) ABSTRACT

A foldable base for a playpen has two sets of side rails (10, 102) (104, 106) respectively mounted on a bottom side of the playpen; two side joints (12, 122) respectively mounted to pivotally receive one end of the rails in a set of the side rails (10, 102) (104, 106); two sets of corner feet (18) respectively connected to one end of the rails (10, 102, 104, 106) of each set of the side rails (10, 102) (104, 106); two sets of connecting bars (14, 142) (144, 146) connected to the side rails (10, 104, 144, 146) near the feet (18); a hinge joint (16) mounted between the two connecting bars (14, 142) (144, 146) of each set of the connecting bars (14, 142) (144, 146); two sets of locking rods (30, 32) connected between the two sets of connecting rods (14, 142) (144, 146); and two inner joints (20) respectively connected to each set of locking rods (30, 32).

6 Claims, 8 Drawing Sheets

FOLDABLE BASE FOR A PLAYPEN

BACKGROUND OF THE INVENTION

1. Field of the Invention

The present invention relates to a foldable base for a playpen, and particularly, to a foldable base that has excellent support and can be used to fold any kind of playpen.

2. Description of Related Art

In U.S. Pat. No. 5,970,540, which also was granted to the same applicant, an improved foldable base for a playpen was disclosed, which included a first pair of side rails pivotally connected to a first side joint and a second pair of side rails pivotally connected to a second side joint. A T-shaped joint is situated between each pair of rails. A central joint is located in the center of the playpen and has outer and inner joints pivotally connected to each other. Two pairs of bars are provided, each pair of the bars is pivotally connected to the respective T-shaped joint and two of the respective side rails. Two linking rods are also provided, each pivotally connected at an end to the respective T-shaped joint and at the opposite end to the respective joint member of the central joint.

However, only one set of linking rods is used to support the bottom of the playpen, resulting in the support area provided by the set of linking rods being too small to sufficiently support the playpen.

Therefore, a foldable base that has excellent support and can be used to fold any kind of playpen is still desired.

SUMMARY OF THE INVENTION

The objective of the present invention is to provide a foldable base that has excellent support and can be used to fold any kind of playpen.

To achieve the objective, the foldable base for a playpen in accordance with the present invention comprises two sets of side rails, two side joints, two sets of corner feet, two sets of connecting bars, two hinge joints, two sets of locking rods and two inner joints. The two sets of side rails are respectively mounted on the bottom of the playpen. The two side rail members in each pair are connected to a side joint to pivotally a complete side rail. A corner foot is mounted on the end of each side rail. The two sets of connecting bars are connected to the side rails near the corner feet. The hinge joint is mounted between the two bars forming each connecting bar. Each set of locking rods is connected between the two sets of connecting rods. An inner joint forms the connection at the midpoint of the locking rods.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
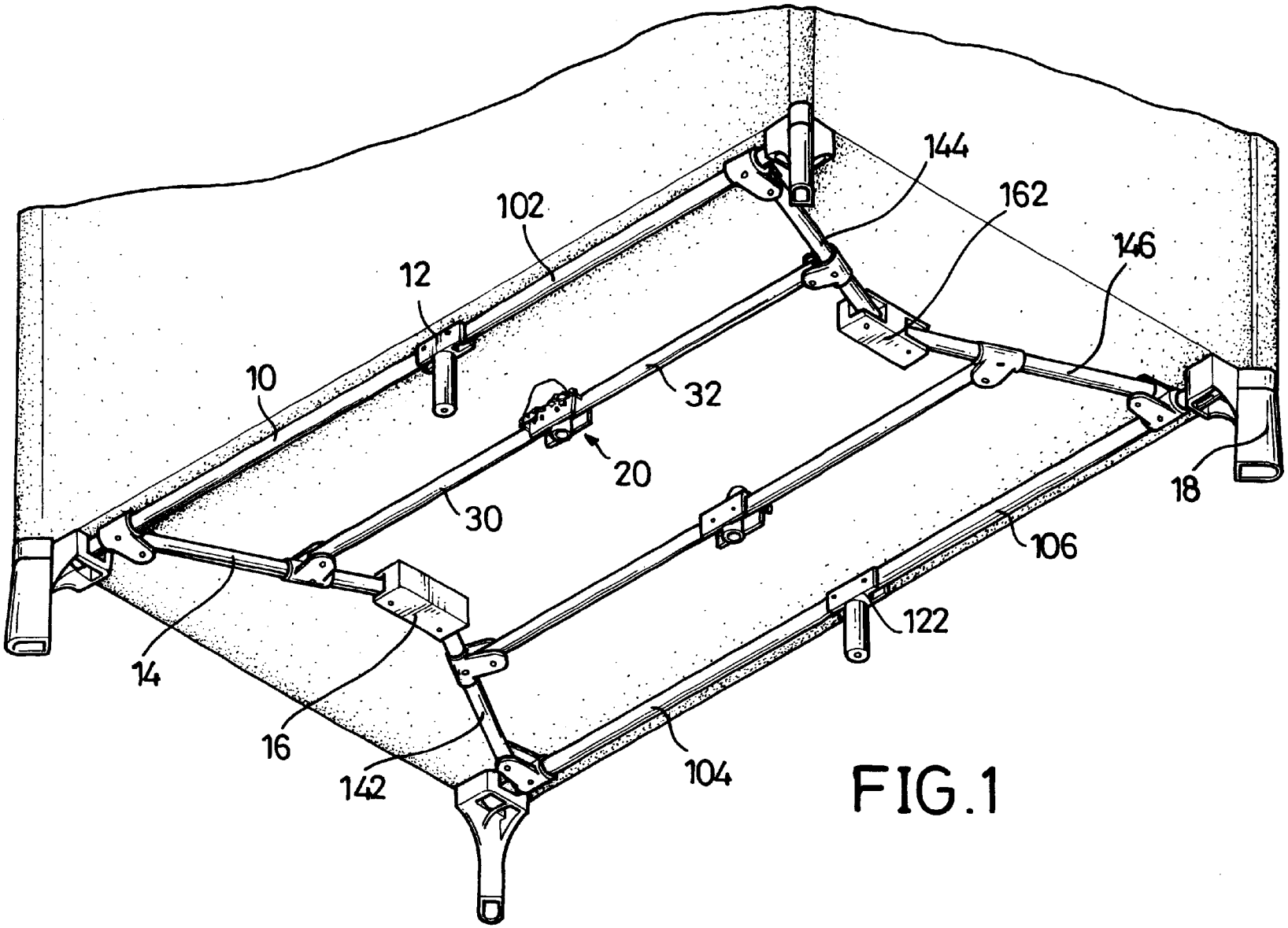
FIG. 1 is perspective view of the foldable base for a playpen in accordance with the present invention.
Figure 2:
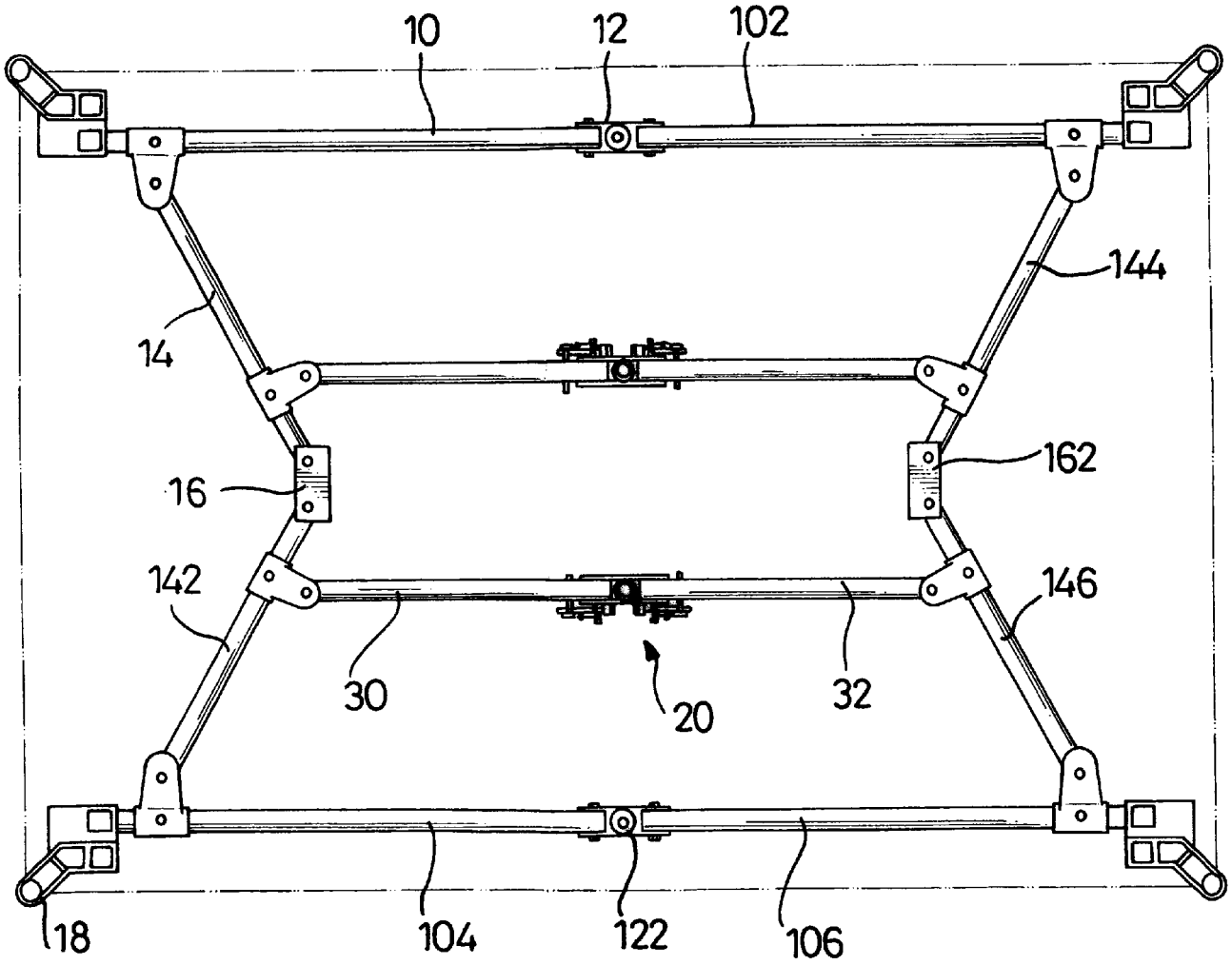
FIG. 2 is bottom plan view of the foldable base in FIG. 1 for a playpen.

With reference to FIGS. 1 and 2, the foldable base for a playpen in accordance with the present invention comprises two sets of side rails (10, 102) (104, 106); two linear side joints (12, 122); two sets of corner feet (18); two sets of connecting bars (14, 142) (144, 146); two hinge joints (16, 162); two sets of locking rods (30, 32), and two inner joints (20).

The two sets of side rails (10, 102) (104, 106) are respectively mounted on the bottom side of the playpen wherein each rail element has one end pivotally connected to one of the two side joints (12) and the other end connected to the one of the corner feet (18).

The two sets of connecting bars (14, 142) (144, 146) are respectively connected to the side rails (10, 102) (104, 106) near the corner feet (18); and each hinge joint (16, 162) is mounted between the two connecting bars (14, 142, 144, 146) forming each set of connecting bars (14, 142) (144, 146).

The two sets of locking rods (30, 32) are respectively connected between the two set of the connecting rods (14, 142) (144, 146), and the two inner joints (20) are respectively used to connect the locking rods (30, 32) to form a set.

Figure 3:
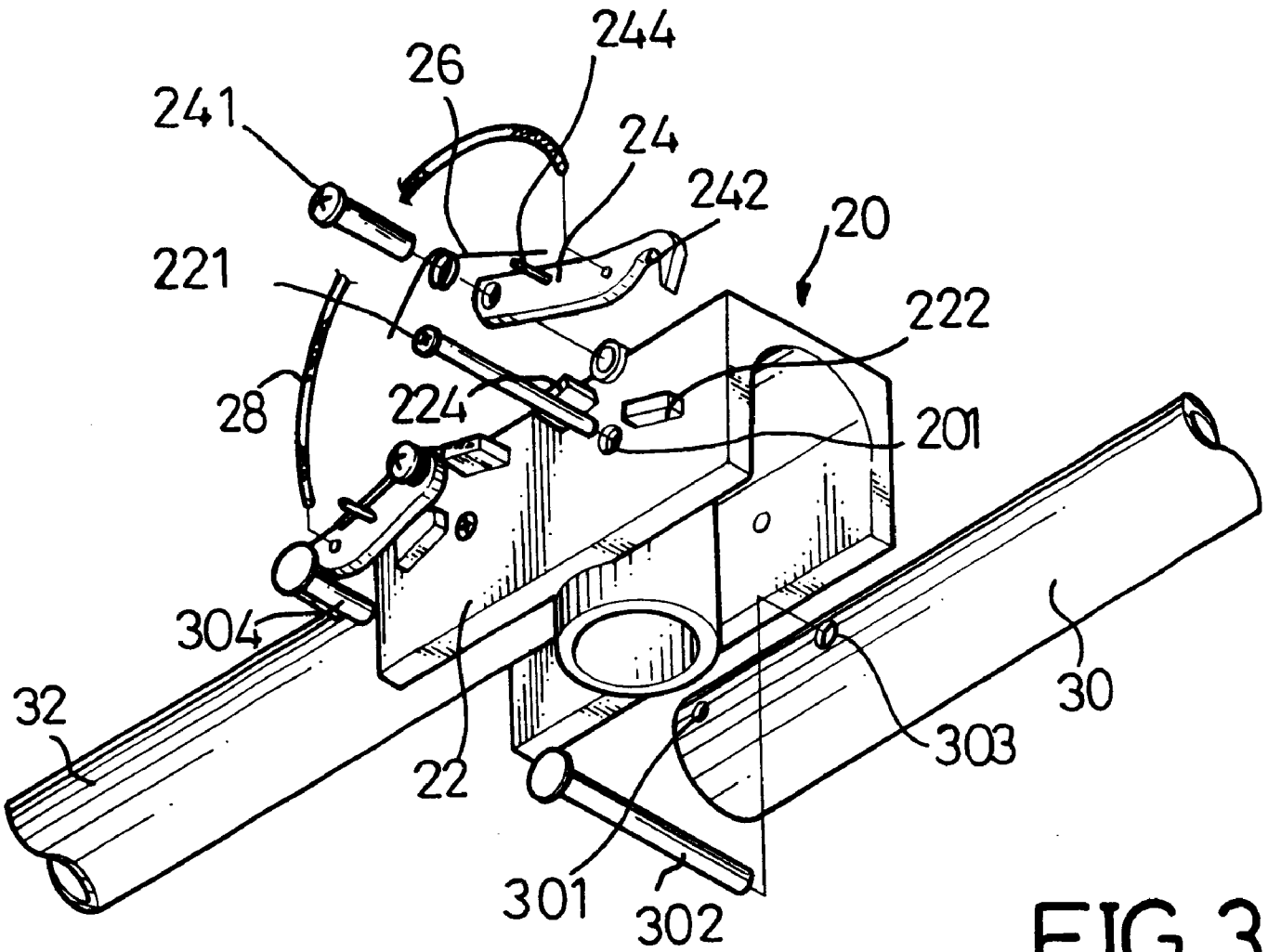
FIG. 3 is an exploded perspective view of the inner joint with the locking rods in FIG. 1.
Figure 4:
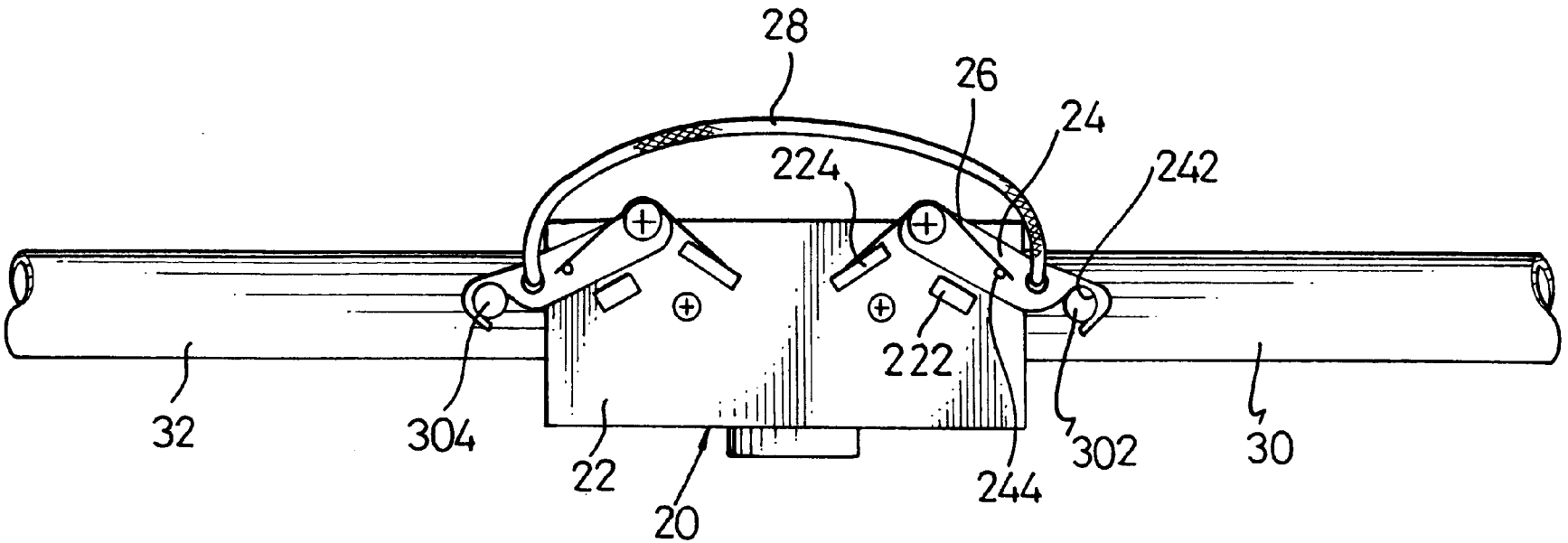
FIG. 4 is side plan view of the innerjoint and the locking rods in FIG. 1 when the locking rods are extended.

With reference to FIG. 3 and FIG. 4, the inner joint member (20) comprises a U-shaped pivotal base (22), a positioning block (222), two locking hooks (24), two springs (26) and a cord (28). Each locking hooks (24) has a locking recess (242) defined on one end and a spring pin (244) extending from the outside cord.

A pair of through holes (301) are formed near the end of the locking rods (30, 32). Two pair of through holes (201) are formed in the base (22) so that a pivot pin (221) can pass through the through holes (201, 301) and pivotally connect the locking rod (30) to the base (22). Another through hole (303) is formed near the end of the locking rod (30). A locking pin (302, 304) passes through the through hole (303) with the head of the locking pin (302, 304) extending out of the through hole (303).

The locking hooks (24) are mounted on the side of the U-shaped pivotal base (22) from which the locking pins (302, 304) extend. The locking recess (242) locks over the exposed end of the corresponding locking pin (302, 304) to lock the locking rod (30) in the extended position.

A spring (28) is connected to each locking hook (24) pivot pin (241) with the ends of the spring pressing against the spring pin (244) and spring block (224).

The cord (28) connects the two locking hooks (24) 50 the cord (28) releases the two locking hooks (24) from the locking pins (302, 304) when the cord (28) is pulled.

Figure 5:
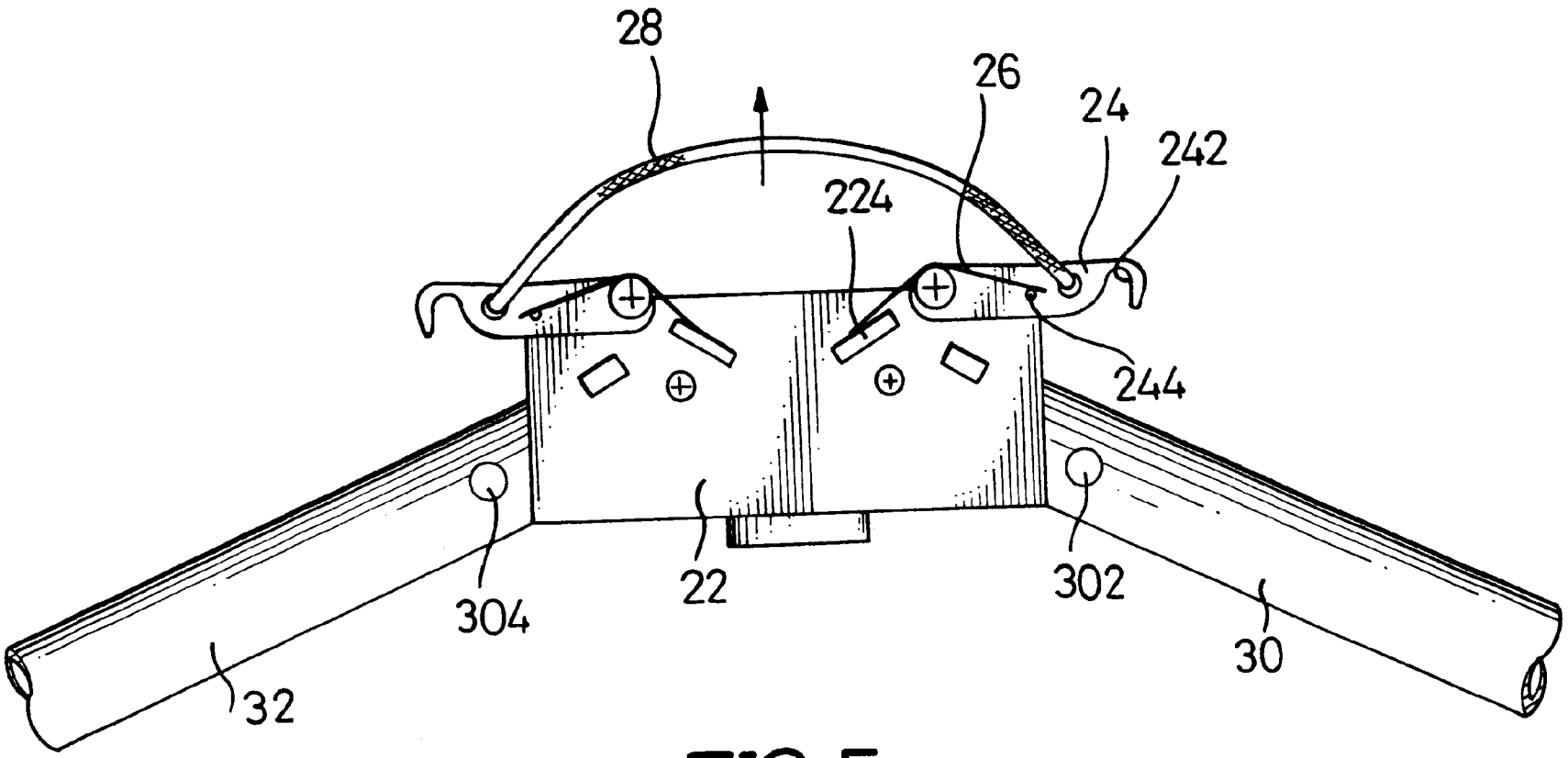
FIG. 5 is an operational side plan view of the innerjoint and the locking rods in FIG. 1 when the locking rods are folded.

With reference to FIG. 5, when the foldable base is to be folded, the cord 28 is pulled such that the two locking hooks (24) release from the two locking pins (302, 304) to allow the two locking rods (30, 32) to pivotally move toward each other.

Figure 6:
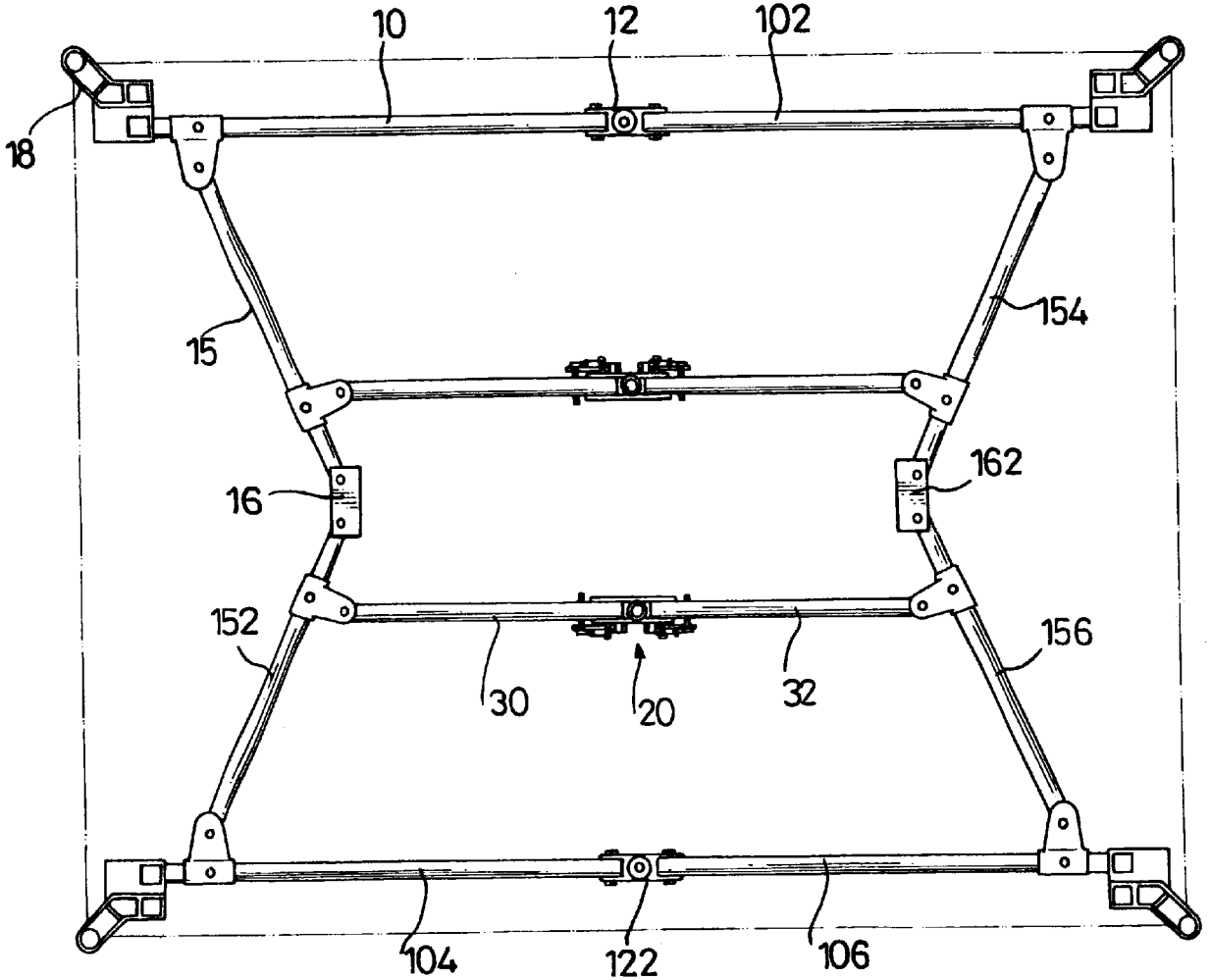
FIG. 6 is a bottom plan view of the foldable base in FIG. 2 for a playpen with different dimensions.

With reference to FIG. 2 and 6, in the case where the base is used with a wider playpen, the two sets of the connecting bars (14, 142) (144, 146) are changed to two sets of longer connecting bars (15, 152) (154, 156). In all other aspects, the bases for the two different playpens are the same.

Figure 7:
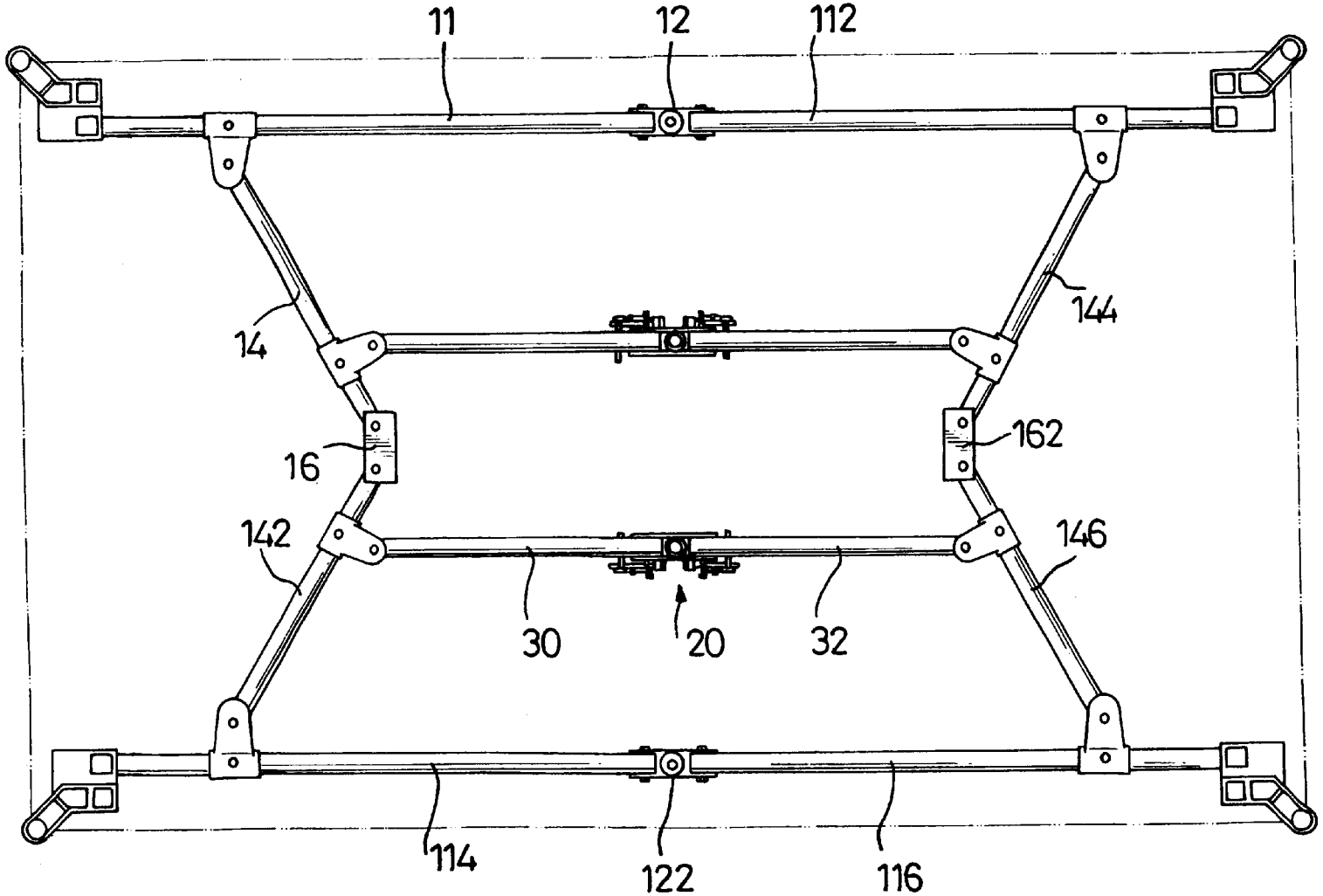
FIG. 7 is a bottom plan view of the foldable base in FIG. 2 for a playpen with different dimensions.

With reference to FIG. 2 and 7, in the case where the base is used with a longer playpen, the two side rails (10, 102) (104, 106) are replaced by two sets of the longer side rails (11, 112) (114, 116). In all other aspects, the bases for the two different playpens are the same.

Figure 8:
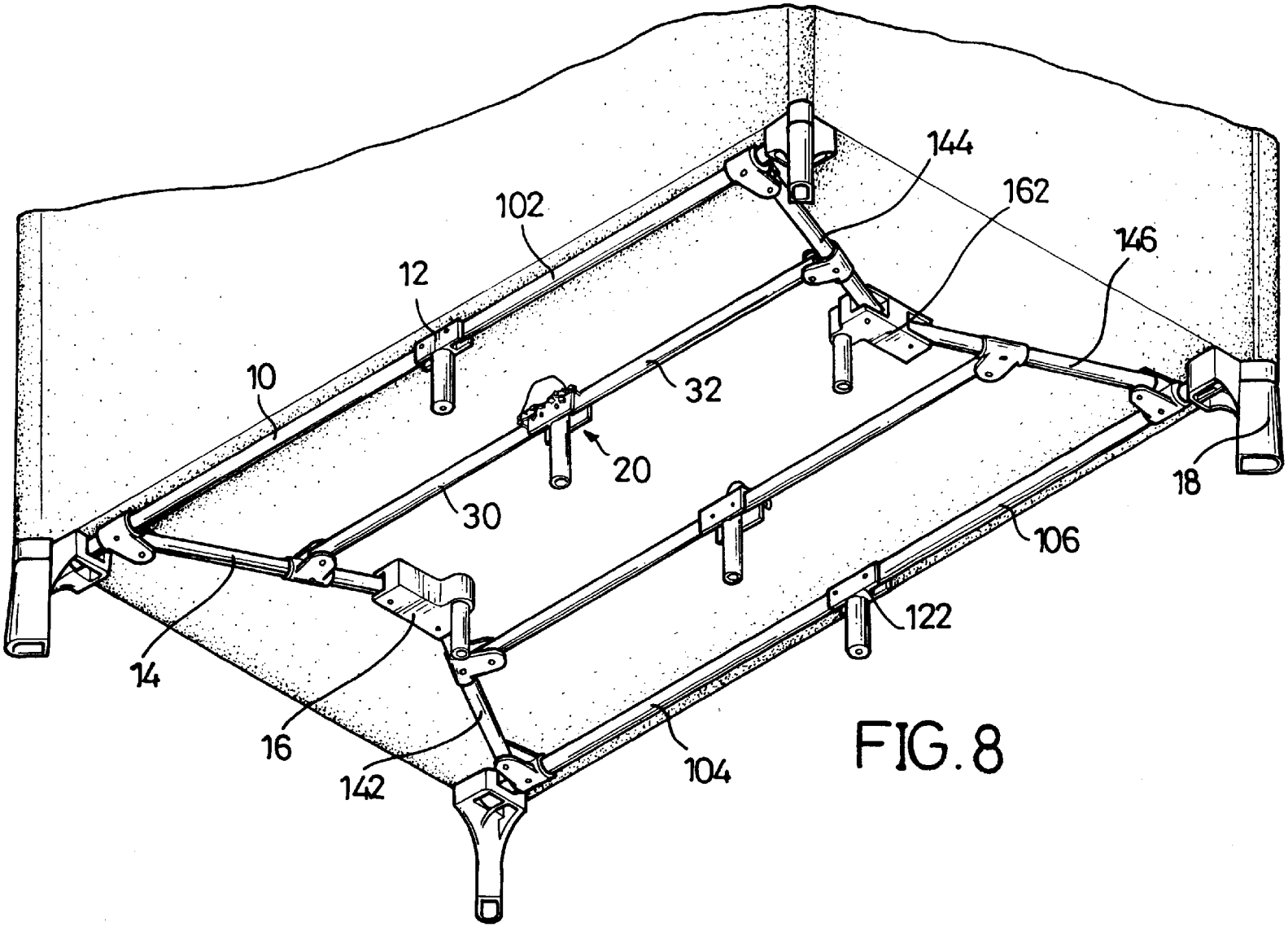
FIG. 8 is perspective view of another embodiment of a foldable base for a playpen in accordance with the present invention.

With reference to FIG. 8, each one of the side joints (12, 122), inner joints (20) and hinge joints (16) can further have a vertical extension to allow the extension to be adjusted to correspond the length of the corner feet (18) and touch the floor, such that the foldable base will be more stable.

Although the present invention has been explained in relation to its preferred embodiment, it is to be understood that many other possible modifications and variations can be made without departing from the spirit and scope of the invention as hereinafter claimed.

What is claimed is:

1. A foldable base for a playpen comprising:

four corner feet (18) respectively mounted on a bottom of the playpen;

two sets of side rails (10, 102) (104, 106) respectively mounted on a bottom side of the playpen with each rail (10, 102, 104, 106) having one end mounted to the corner feet (18);

two side joints (12, 122) respectively mounted to pivotally receive one end of the rails in a set of side rails (10, 102) (104, 106);

two sets of connecting bars (14, 142) (144, 146) mounted on the side rails (10, 104, 144, 146) near the feet (18);

a hinge joint (16) mounted to pivotally receive one end each of the two connecting bars (14, 142) (144, 146) of each set of the connecting bars (14, 142) (144, 146);

two sets of locking rods (30, 32) connecting between the two set of the connecting rods (14, 142) (144, 146); and an inner joint (20) pivotally connected to each set of the locking rods (30, 32).

2. The foldable base for a playpen as claimed in claim 1, wherein the inner joint (20) comprises a U-shaped pivotal base (22), a positioning block (222) extending from one side;

two locking hooks (24) mounted on the side of the U-shaped pivotal base (22) and each with a locking recess (242) defined on one end and a spring pin (244) extending from the outside; and two springs (26) each mounted on one end of the locking hook (24).

3. The foldable base for a playpen as claimed in claim 2, wherein an extension extends from each of the side joints (12, 122), the hinge joints (16, 162) and the inner joints (20).

4. The foldable base for a playpen as claimed in claim 1, wherein a cord connects the two locking hooks (24).

5. The foldable base for a playpen as claimed in claim 1, wherein an extension extends from each of the side joints (12, 122), the hinge joints (16, 162) and the inner joints (20).

6. The foldable base for a playpen as claimed in claim 1, wherein a spring (28) is mounted on the end of each locking hook (24) such that the ends of the spring (28) abut the spring pin (244) and the spring block (224) to press the spring (26) against the positioning block (22).

* * * * *